US007617868B2

(12) United States Patent
Stuart et al.

(10) Patent No.: US 7,617,868 B2
(45) **Date of Patent: *Nov. 17, 2009**

(54) LINER ANCHOR FOR EXPANDABLE CASING STRINGS AND METHOD OF USE

(75) Inventors: David John Stuart, Westhill (GB); Robert C. Smith, Aberdeen (GB)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/082,250

(22) Filed: Apr. 10, 2008

(65) Prior Publication Data

US 2008/0210440 A1 Sep. 4, 2008

Related U.S. Application Data

(63) Continuation of application No. 11/646,686, filed on Dec. 28, 2006, now Pat. No. 7,367,391.

(51) Int. Cl.
*E21B 43/10* (2006.01)

(52) U.S. Cl. ..... 166/208; 166/384; 166/382; 166/380; 166/207

(58) Field of Classification Search ..... 166/382, 166/380, 384, 207, 208
See application file for complete search history.

(56) References Cited

U.S. PATENT DOCUMENTS 7,367,391 B1 * 5/2008 Stuart et al. ..... 166/208

* cited by examiner

*Primary Examiner*—Jennifer H Gay
*Assistant Examiner*—Sean D Andrish
(74) *Attorney, Agent, or Firm*—Greenberg Traurig LLP; Anthony F. Matheny

(57) ABSTRACT

Expandable casing has an expandable slip used for completion of a mono-diameter wellbore. The expandable casing is run through the upper casing and has an upper end that overlaps a lower end of the upper casing to form a fluid flow path between the expandable casing and the upper casing. The operator expands the overlapping portion of the expandable casing to an intermediate position, causing the expandable slip to anchor the expandable casing to the upper causing without blocking the flow path. Cement is then pumped up around the outside of the expandable casing and wellbore fluid displaced by the cement and excess cement are permitted to flow through the fluid flow path and up the upper casing. After sufficient cement is in place, the expandable casing is further expanded, compressing the expandable slip into to the inner wall of the upper casing and sealing off the fluid flow path.

20 Claims, 10 Drawing Sheets

LINER ANCHOR FOR EXPANDABLE CASING STRINGS AND METHOD OF USE

RELATED APPLICATION

This application is a continuation of, and claims priority to, U.S. patent application Ser. No. 11/646,686 filed Dec. 28, 2006 now U.S. Pat. No. 7,367,391.

BACKGROUND

1. Field of Invention

The invention is directed to expandable casing having an expandable slip for anchoring or securing the expandable casing to a section of upper casing disposed within oil and gas wells.

2. Description of Art

Use of expandable casing to form a "mono-diameter" wellbore within open hole oil or gas wells is known in the art. As is also known in the art, during the formation of mono-diameter wellbores, each completed section of the wellbore is required to be isolated to ensure safe operation during production of the well after completion. By forming a mono-diameter wellbore with the expandable casing as part of the oil or gas well, problems with depth control due to hydraulic effects caused by increasing pressure as the depth of the well is increased are eliminated.

While several methods may be possible for providing zonal isolation, generally, the wellbore is formed in accordance with the prior art by circulating cement around the casing string. During such operations, it is desirable to attach one portion of casing string to another portion of casing string disposed above the first portion prior to pumping cement so that issues with depth control due to hydraulic effects can be avoided. Due to limitations of current hole opening or current reaming technologies, the clearance between the open hole and the expanded liner or casing already disposed within the open hole is insufficient to allow adequate circulation of cement. Thus, the cement needs to be pumped prior to expansion of the expandable casing or liner that is being run-in. Pumping cement after expansion of the expandable casing poses the problem of having a return path for the circulating fluids being displaced by the cement.

This problem is addressed in prior systems by placing windows or holes in the expandable casing that is being run in so that wellbore fluids and cement can circulate through the windows of the expandable casing during cementing of the expandable casing and, thus, into contact with the wellbore. The wellbore fluids and cement flow upward around the liner and through the windows or openings. The cement is used to block the windows as it forms the wellbore. Although, these prior systems result in a wellbore being formed, these prior systems have several shortcomings such as not always adequately blocking the windows, interfering with the expansion of the expandable casing to its set position, and, in some cases, providing an asymmetric casing bore. As is apparent to persons skilled in the art, such shortcomings of the prior systems are not desired.

Accordingly, prior to the development of the present invention, there has been no expandable casing, anchoring system for expandable casing, or method known to the inventors of securing an expandable casing within a section of upper casing disposed in a well that: provides sufficient attachment of the expanding casing to the upper casing; provides complete zonal isolation of the completed section of expandable casing; and provides a flow path for circulating cement during expandable bore construction without the need for the expandable casing to include return ports. Therefore, the art has sought expandable casing, anchoring systems for expandable casing, and methods of securing an expandable casing within a section of upper casing disposed in a well that: provide sufficient attachment of the expanding casing to the upper casing; provide complete zonal isolation of the completed section of expandable casing; and provide a flow path for circulating cement during expandable bore construction without the need for the expandable casing to include return ports.

SUMMARY OF INVENTION

Broadly, a wellbore is formed by placing a section of casing or liner within an open hole. After this upper casing is in place, a section of expandable casing is run-in the upper casing and expanded. As used herein, the term "casing" includes a single tubular or piece of casing or a casing string formed of several pieces of casing. The term "casing" also includes what is known in the art as a liner. The expandable casing has one or more expandable slips disposed on its outer surface. The expandable slips allow the expandable casing to be partially expanded to form a fluid by-pass flow path through which wellbore fluids and the like can pass to flow out of the well during cementing of the expandable casing within the well. The expandable slips can then be further expanded, closing or blocking the flow path and compressing, or biting, the expandable slips into the inner wall of the upper casing.

In addition to the creation of the flow path, the expandable slips of the expandable casing facilitate attachment of the expandable casing to the inner wall of the upper casing. In one particular embodiment, the expandable slips are designed to expand outward, thus shortening due to the volume of the bore of the housing increasing, as they are compressed into the inner wall of the upper casing. The shortening of the expandable slips is minor, e.g., generally between 3% and 4%. In another specific embodiment, the expandable slips are designed to lengthen and compress in a single direction, either upward or downward, to increase the biting force of the expandable slips into the inner wall of the casing. In yet another embodiment, the expandable slips do not shorten or lengthen. In another preferred embodiment, the expandable slips have a "wave-shaped" cross section having one or more peak and valley. The peak(s) on the outer surface of the expandable slips include gripping elements and the peak(s) on the inner surface of the expandable slips (identified as valleys on the outer surface of the expandable casing) include one or more retaining members, such as teeth, that matingly engage with one or more retaining members disposed on the outer wall surface of the expandable casing. In a preferred embodiment, the retaining member on the outer surface of the expandable casing is disposed within a recess or pocket on the outer surface of the expandable casing. Therefore, as the expandable slips are compressed into the inner wall of the upper casing, the reciprocal retaining members lock into each other and create a resultant, upward force into the inner wall of the upper casing causing the expandable slip to lengthen and bite into, and become secured to, the inner wall of the upper casing.

The expandable casing, anchoring system for expandable casing, and method of securing an expandable casing within a section of upper casing disposed in a well have one or more of the advantages of: providing sufficient attachment of the expanding casing to the upper casing; providing complete zonal isolation of the completed section of expandable casing; and providing a flow path for circulating cement during expandable bore construction without the need for the expandable casing to include return ports.

In one aspect, one or more of the forgoing advantages can be achieved through a hanger assembly for securing a string of expandable casing to an upper casing. The hanger assembly comprises a radially expandable housing for securing to an upper end of the expandable casing and location within a lower portion of the upper casing; an annular radially expandable seal on the housing; and a plurality of lengthwise expandable slips disposed around the housing, each of the lengthwise expandable slips having a wave-shape with a peak having at least one gripping element and two valleys disposed on either side of the peak, the expandable housing being radially expandable from a run-in position to a partially expanded position, wherein the peak contacts an inner wall of the upper casing to anchor the expandable casing, and the seal is still spaced from the inner wall of the upper casing to provide a flow path for cement returns, and the expandable housing being further expandable from the partially expanded position to a set position, wherein the peak bites into the inner wall of the upper casing and the seal seals against the upper casing.

A further feature of the hanger assembly is that each of the expandable slips may comprise elongated strips spaced around a circumference of the housing. Another feature of the hanger assembly is that the housing may have a plurality of elongated axially extending pockets, and one of the expandable slips is located in each of the pockets. An additional feature of the hanger assembly is that the at least one gripping element disposed on the peak may be disposed on an outer surface of each of the expandable slips; a slips retaining member may be disposed on a slip inner surface of each of the slips, and the pocket may include a pocket retaining member for matingly engaging with the slips retaining member. Still another feature of the hanger assembly is that each of the valleys of the expandable slips may be fixed to the housing. A further feature of the hanger assembly is that one end of each of the expandable slips may be fixed to the housing so as to remain at the same point on the housing between the run-in and the set positions. Another feature of the hanger assembly is that the housing and each of the expandable slips may have mating teeth that are inclined so as to allow one end of the expandable slips to ratchet axially relative to the housing while the expandable slips move from the run-in position to the set position.

In another aspect, one or more of the foregoing advantages may be achieved through a well comprising a section of upper casing in the well; a section of expandable casing extending into the well below the upper casing; and a radially expandable housing on an upper end of the expandable casing, the housing having a slips assembly and a seal, the housing, slips assembly, and seal being located within a lower portion of the upper casing and spaced from an inner surface defined by a diameter of the lower portion of the upper casing to define a flow path, the housing being radially expandable from a run-in outer diameter to an intermediate outer diameter, wherein the slips assembly contacts the inner surface of the lower portion of the upper casing to anchor the expandable casing, and the seal is still spaced from the inner surface of the lower portion of the upper casing, enabling cement returns to flow back up around the expandable casing and expandable housing through the flow path into the upper casing, and the housing being expandable from the intermediate outer diameter to a set diameter wherein the seal seals against the inner surface of the outer casing to block the flow path.

A further feature of the well is that the slips assembly may include an expandable slip having a peak and two valleys disposed on either side of the peak, each of the two valleys being fixed to the housing. Another feature of the well is that the slips assembly may have a first end and a second end and one of the first end or the second end is fixed to the housing. An additional feature of the well is that the slips assembly may comprise a plurality of elongated members spaced around housing, with part of the flow path extending between the elongated members of the slips assembly. Still another feature of the well is that the housing and the slips assembly may have mating teeth that are inclined, so that one end of the slips assembly is fixed and the other end of the slips assembly slides to elongate the slips assembly. A further feature of the well is that the slips assembly may have at least one gripping element disposed on an outer side of the slips assembly to grip the upper casing when the housing is radially expanded to the intermediate outer diameter and to the set diameter. Another feature of the well is that the slips assembly may have a plurality of peaks and valleys and each of the plurality of peaks contacts the inner surface of the lower portion of the upper casing when the housing is radially expanded from the run-in outer diameter to the intermediate outer diameter and each of the plurality of peaks deforms when the housing is further radially expanded from the intermediate outer diameter to the set diameter. An additional feature of the well is that the lower portion of the upper casing may have an inner diameter larger than a nominal inner diameter of the upper casing located above. Still another feature of the well is that the expandable casing may be expandable to a set inner diameter substantially the same as the nominal inner diameter of the upper casing.

In an additional aspect, one or more of the foregoing advantages may be achieved through a method of installing casing within a wellbore. The method comprise the steps of: (a) running and cementing a section of upper casing within a wellbore; (b) drilling a lower section of the wellbore below the upper section of casing; (c) running an expandable casing through the upper casing into the wellbore, the expandable casing having housing and an expandable slip disposed on an outer wall surface of the housing, the housing locating within a lower portion of the upper casing, defining a flow path between the housing and the lower portion of the upper casing; (d) partially expanding the housing so that the expandable slip contacts an inner wall surface of the lower portion of upper casing to anchor the expandable casing but not block the flow path; then (e) pumping cement up an annulus surrounding the expandable casing and causing cement returns to flow through the flow path and up the upper casing; and then (f) further expanding the housing causing the fluid flow path to be blocked.

A further feature of the method of installing casing within a wellbore is that the outer wall surface of the housing may include at least one seal and during step (f) at least one of the at least one seals engages the inner wall of the upper casing and blocks the flow path. Another feature of the method of installing casing within a wellbore is that step (a) may comprise providing the lower portion of the upper casing with a larger inner diameter than the remaining portion of the upper casing. An additional feature of the method of installing casing within a wellbore is that during step (f), the expandable slip may bite into the inner wall surface of the upper casing and an upper end of the expandable slip slides in an upward direction relative to a lower end of the expandable slip.

Figure 1A:
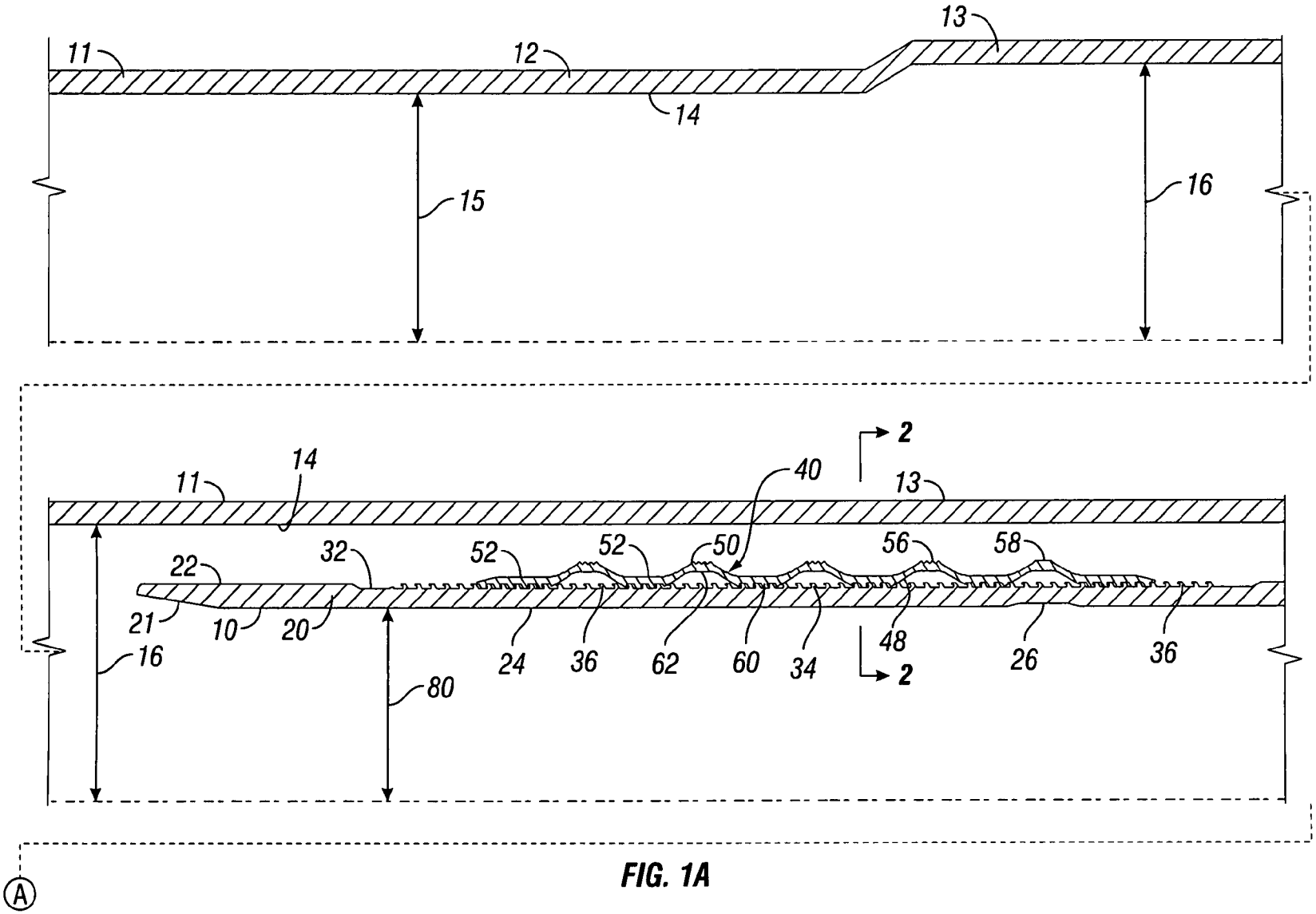
FIG. 1A is a cross-sectional view of an upper section of a upper casing and an upper section of an expandable casing disposed therein, with the upper section of the expandable casing shown in its initial or run-in position.
Figure 1B:
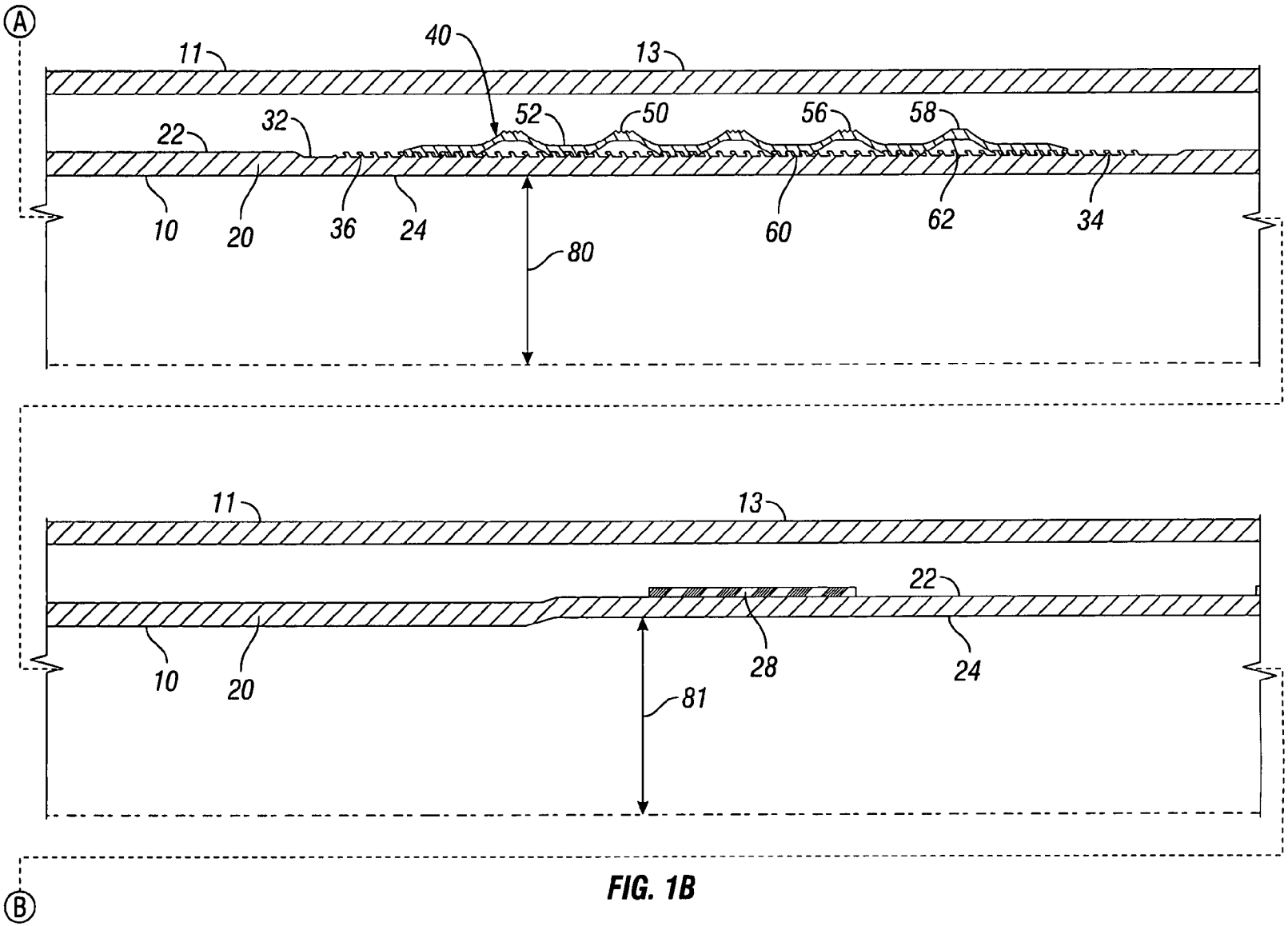
FIG. 1B is a cross-sectional view of a middle section of the upper casing and a middle section of the expandable casing disposed therein referred to in FIG. 1A, with the middle section of the expandable casing shown in its initial or run-in position.
Figure 1C:
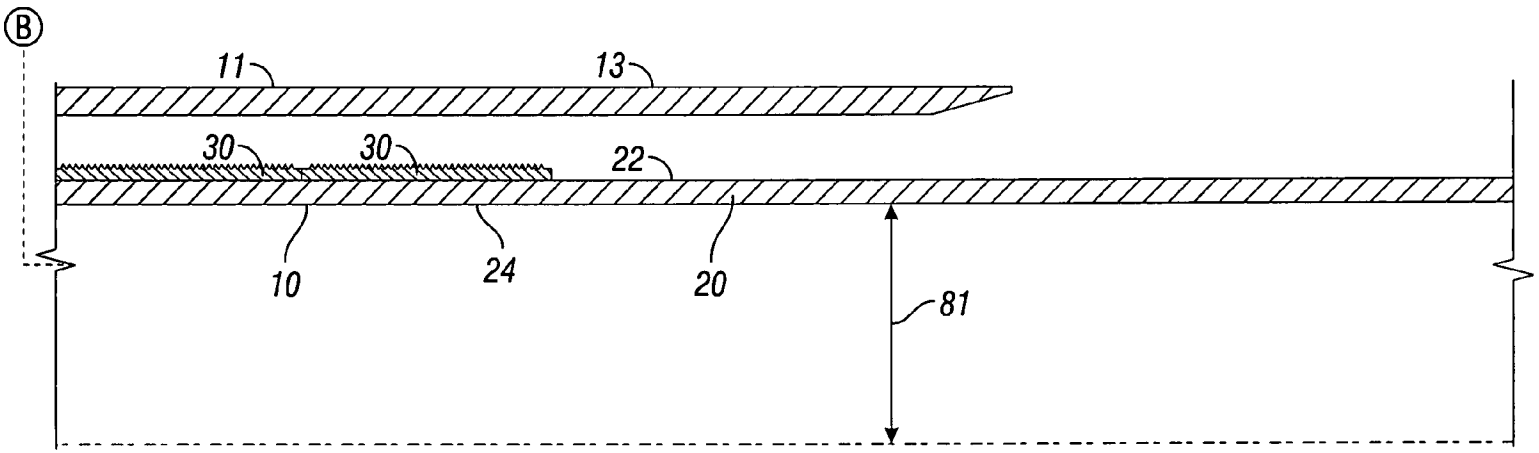
FIG. 1C is a cross-sectional view of a lower section of the upper casing and a lower section of the expandable casing disposed therein referred to in FIGS. 1A and 1B, with the lower section of the expandable casing shown in its initial or run-in position.
Figure 2:
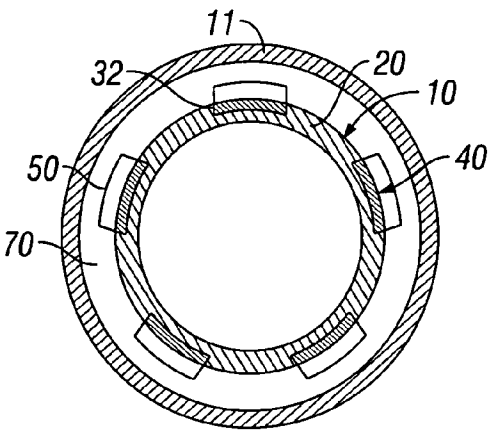
FIG. 2 is a cross-sectional view of the upper casing and expandable casing shown in FIGS. 1A-1C taken along line 2-2 in FIG. 1A.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Referring now to FIGS. 1A-5C, expandable liner or casing 10 is lowered through a previously run section of casing 11, also referred to herein as upper casing 11, having an upper portion 12, lower portion 13, and inner wall surface 14. Lower portion 13 is located downhole from upper portion 12. Upper portion 12 has a diameter determined by radius 15 and lower portion 13 has a diameter determined by radius 16. Radius 15 is smaller than radius 16. The upper portion of expandable casing 10 overlaps and is located within the lower portion 13 of upper casing 11.

Figure 5A:
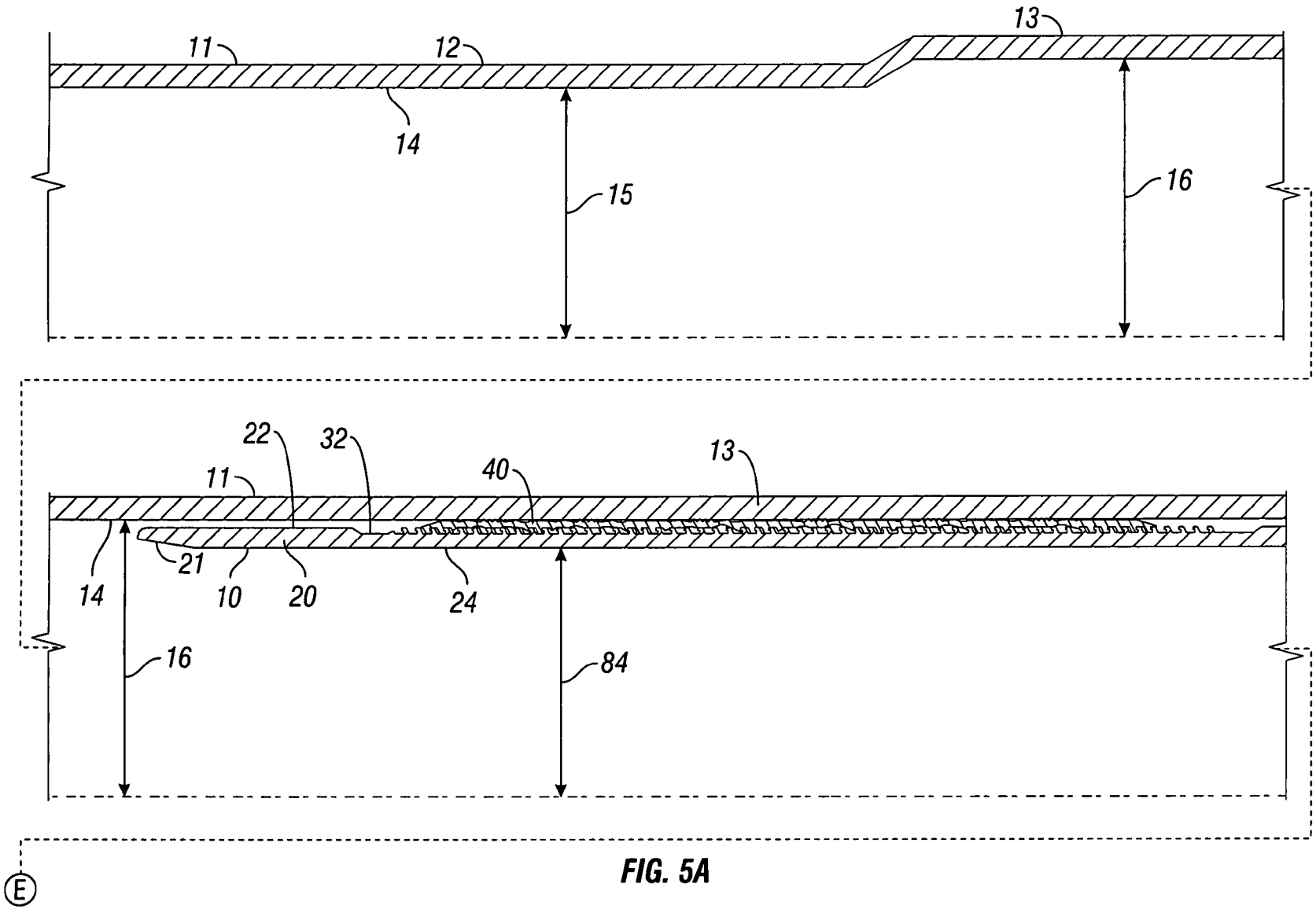
FIG. 5A is a cross-sectional view of the upper section of the upper casing and the upper section of the expandable casing shown in FIG. 1A with the upper section of the expandable casing shown in its set position.
Figure 5B:
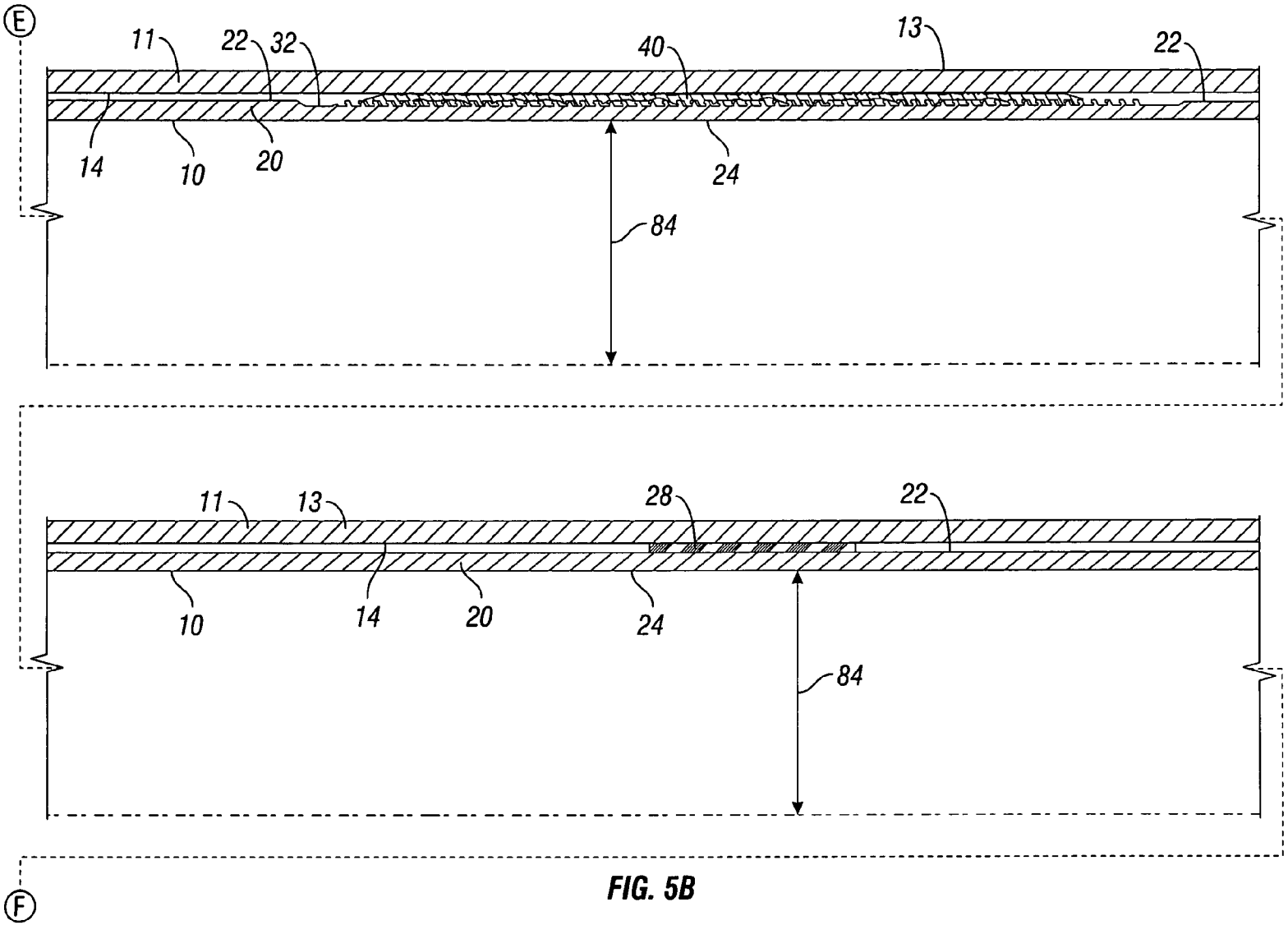
FIG. 5B is a cross-sectional view of the middle section of the upper casing and the middle section of the expandable casing shown in FIG. 1B with the middle section of the expandable casing shown in its set position.
Figure 5C:
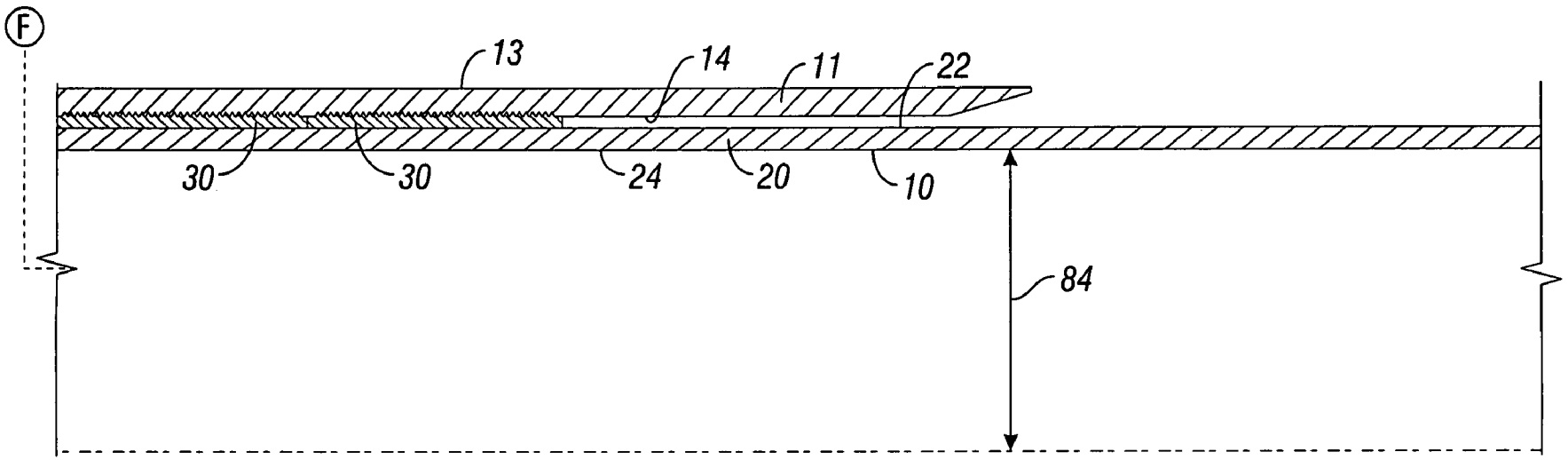
FIG. 5C is a cross-sectional view of the lower section of the upper casing and the lower section of the expandable casing shown in FIG. 1C with the lower section of the expandable casing shown in its set position.

Broadly, the upper end of expandable liner or casing 10 comprises a hanger 21 that includes a housing 20 and slips 40. Housing 20 includes outer wall 22 having an outer diameter and inner wall 24 having an inner diameter. Inner wall 24 preferably includes recess 26, which is an annular enlarged diameter portion. Housing 20 is preferably secured to the expandable casing 10 by threads, welding or any other suitable means. Outer wall 22 includes one or more elastomeric, or non-elastomeric, seals 28 (FIG. 1B) and one or more permanent slips 30 (FIG. 1C), both of which are known to persons skilled in the art. Each seal 28 and a set of permanent slip 30 are designed to engage inner wall surface 14 upper casing 11 when expandable casing 10 is placed in its set position (FIGS. 5A-5C). Although not shown in detail permanent slips 30 are spaced circumferentially around housing 10 and have teeth or wickers on the outer side.

Figure 3:
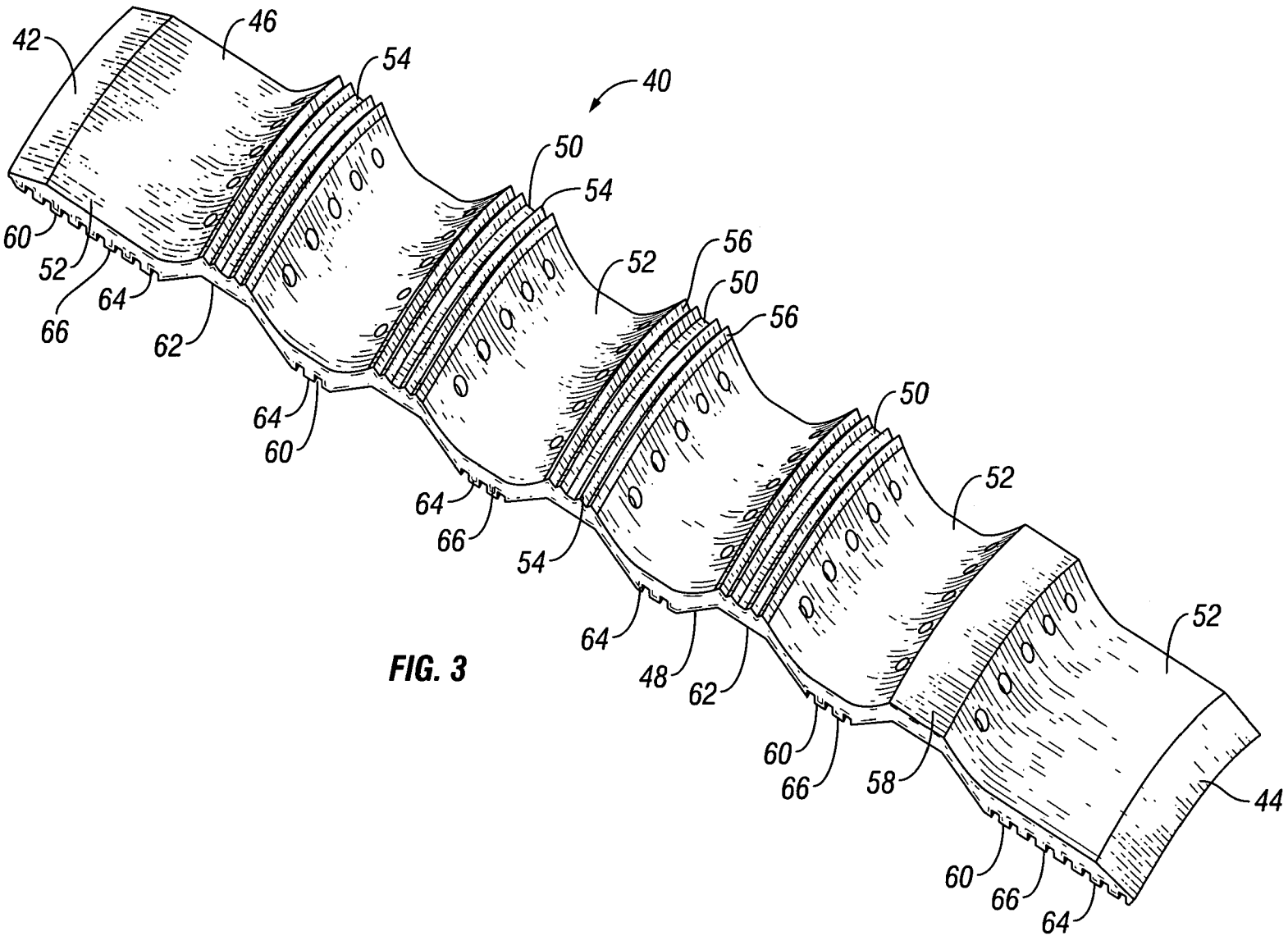
FIG. 3 is perspective view of an expandable slip of the expandable casing shown in FIGS. 1A-1C.

Additionally, outer wall 22 also includes one or more sets or arrays of pockets 32, each set being spaced circumferentially around housing 20, as shown in FIG. 3. As shown in FIGS. 1A, 1B, 4A, 4B, 5A, and 5B, outer wall 22 includes two sets of pockets 32, one set being located above the other set; however, it is to be understood the additional sets of pockets 32 or only one set of pockets 32 may be disposed circumferentially around outer wall 22. Each pocket 32 is an elongated recess and includes retaining member 34, such as teeth 36. Teeth 36 are preferably angled upward, i.e., up-hole, and are circumferentially-extending saw-tooth grooves. Teeth 36, however, may be angled downward.

An expandable slip 40 is deposed in each pocket 32. Referring now to FIG. 3, each expandable slip 40 has upper end 42, lower end 44, outer wall surface 46, and inner wall surface 48. Preferably, upper end 42 and lower end 44 are angled or beveled. Each slip 40 is an elongated axially extending member that fits closely within the side walls of one of the pockets 32.

As best shown in FIG. 3, but also illustrated in FIGS. 1A, 1B, 4A, and 4B, in a preferred embodiment, expandable slip 40 has a wave-shape when viewed from the side or in cross-section, such that outer wall surface 46 includes peaks 50 and valleys 52. Gripping elements 54 are disposed on each peak 50. Gripping elements 54 may include wickers or teeth 56 or any other gripping profile known to persons of ordinary skill in the art. Preferably, at least one of gripping elements 54 does not include a gripping profile. Instead, this gripping element 54, reference number 58 shown best in FIG. 1A, is smooth. Smooth gripping element 58 acts as a wear pad during run-in of expandable casing 10 to facilitate removal of debris or other materials that may interfere with the interface of gripping members 54 with the inner wall surface 14 of casing 11. Recess 26 is disposed along inner wall surface 48 opposite smooth gripping element 58 to accommodate for the shorter height of smooth gripping element 58 compared to gripping elements 54. Therefore, recess 26 permits smooth gripping element 58 to engage inner wall surface 14 of upper casing 11 contemporaneously with gripping elements 54 engaging inner walls surface 14.

Gripping elements 54, as well as the rest of expandable slip 40, may also be formed of any material known to persons of ordinary skill in the art. Preferably, slip 40 and gripping elements 54 are formed of a malleable metal, such as steel, or alloys thereof.

Inner wall surface 48 of each slip 40 includes one or more peak 60 and one or more valley 62. As shown in the embodiment illustrated in FIGS. 1A, 1B, 3, 4A, and 4B, peak 60 is opposite valley 52 of outer wall surface 46 and valley 62 is opposite peak 50 of outer wall surface 46. Peaks 60 of inner wall surface 48 include retaining member 64, such as teeth 66. Teeth 66 are parallel grooves and preferably angled downward, i.e., downhole, so that teeth 66 matingly engage with upwardly angled teeth 36 of pocket 32. Thus, slip 40 is held within pocket 32 by matingly engaging teeth 66 with teeth 36. Additionally, because of the angles of teeth 66 and teeth 36, whether angled upward (as shown) or downward (not shown), slip 40 is compressed at least partially in the space available between teeth 66 and teeth 36 during expansion of expandable casing 10.

In addition to the engagement of teeth 66 with teeth 36, in one embodiment, slip 40 is retained in pocket 32 by bonding, e.g., chemical bonding or gluing, or welding slip 40 to pocket 32. In this embodiment, preferably each valley 62 is bonded or welded to pocket 32. Thus, in this embodiment, slip 40 is not permitted to move, e.g., ratchet, up or down pocket 32. When compressed into inner wall surface 14 of upper casing 11 by expansion of housing 20 (discussed in greater detail below), expandable slip 40 cannot move axially. As a result, each expandable slip 40 expands outwardly, or radially, and, thus, slightly shortens in overall length. In so doing, gripping elements 54 bite into inner wall surface 14 of upper casing 11.

Expandable casing 10 having expandable slips 40 is used to form a cased wellbore having a substantially constant diameter, i.e., a mono-diameter bore or monobore, by allowing a string of expandable casing 10 to be anchored to a previously run section of casing 11. In so doing, expandable casing 10 is designed to provide a circulation path around the exterior of expandable casing 10 and into casing 11 so that wellbore fluids can be circulated from the wellbore when expandable casing 10 is being cemented in place.

In operation, the previously run section of casing 11 is disposed within a wellbore and cemented in place. As mentioned above, casing 11 includes two diameters, a nominal determined by radius 15 and an enlarged lower portion diameter determined by radius 16, where radius 15 is smaller than radius 16. Expandable casing 10 and housing 20 have an outer diameter that is smaller than the nominal diameter of casing determined by radius 15. In its run-in position (FIGS. 1A-1C), expandable casing 10 preferably has two inner diameters, one determined by radius 80 and the other determined by radius 81. Radius 81 is slightly larger than radius 80 to facilitate expansion. However, radius 81 is less than radius 15 of upper casing 11 so that expandable casing 10 can be run-in upper casing 11.

Expandable casing 10 is run to depth and its hanger or housing 20 is located within lower portion 13 of upper casing 11 which is the section of upper casing 11 having radius 16. In the run-in position, peaks 50 of slips 40 are spaced from upper casing inner wall 14 by a clearance or flow path 70. Thereafter, expandable casing 10 is partially expanded from the run-in position (FIGS. 1A-1C) to the partially expanded position (FIGS. 4A-4C) so that each of the gripping elements 54, 58 is in contact with, and, preferably, partially bites into, inner wall surface 14 of casing 11. Alternatively, only one of gripping elements 54 or 58 may be in contact with inner wall surface 14 of casing 11. In this intermediate, or partially expanded position, slip 40 is pushed outward, i.e., radially expanded, due to each end 42, 44 of slip 40 being fixed to pocket 32 through welding or other bonding mechanism and the expansion of housing 20. Seal 28 and permanent slips 30 are still spaced radially from inner wall 14 of upper casing 11. Flow path 70 is smaller but still open around seal 28 and between each of the slips 40.

Figure 4A:
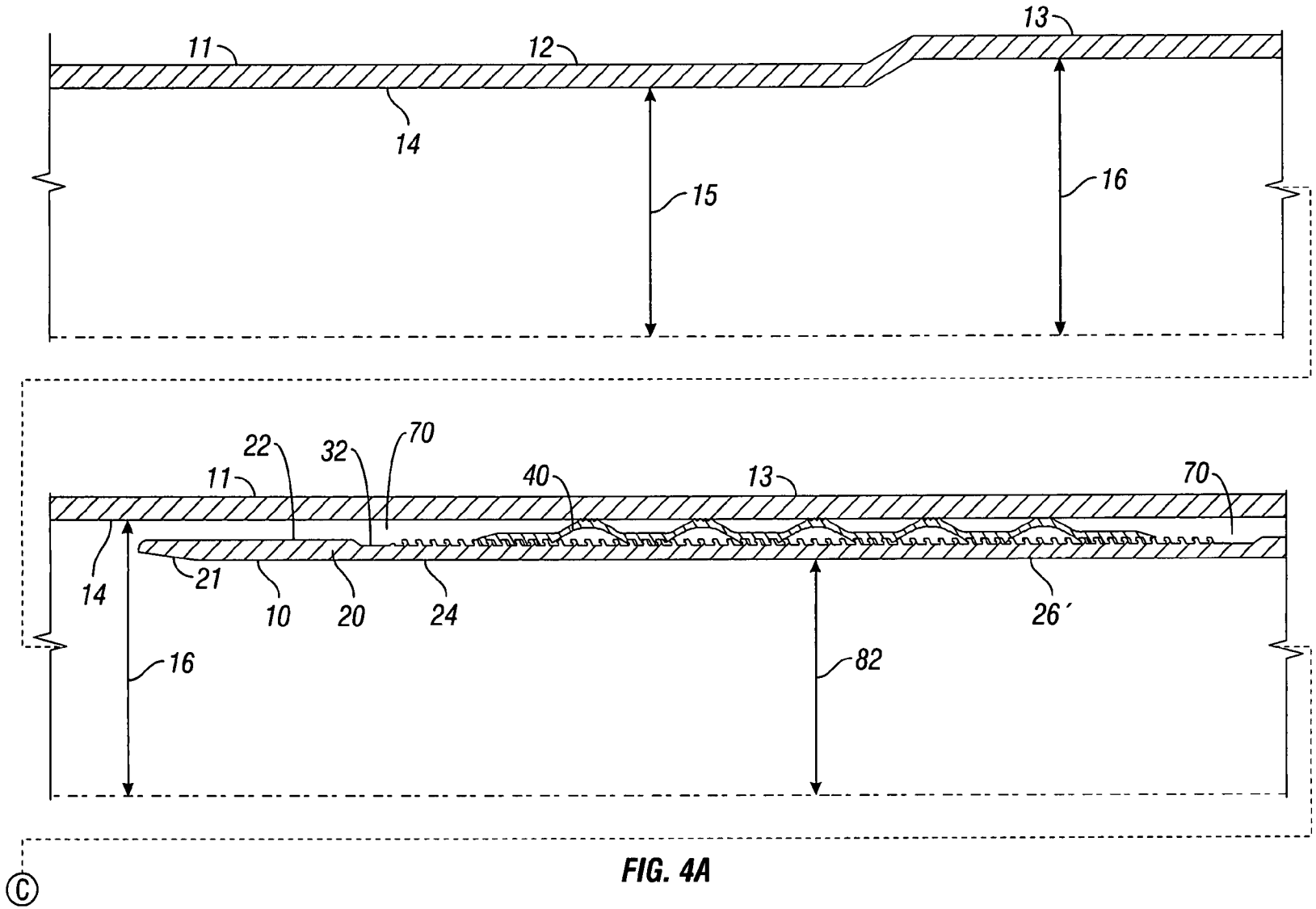
FIG. 4A is a cross-sectional view of the upper section of the upper casing and the upper section of the expandable casing shown in FIG. 1A with the upper section of the expandable casing shown in its partially expanded or by-pass position.
Figure 4B:
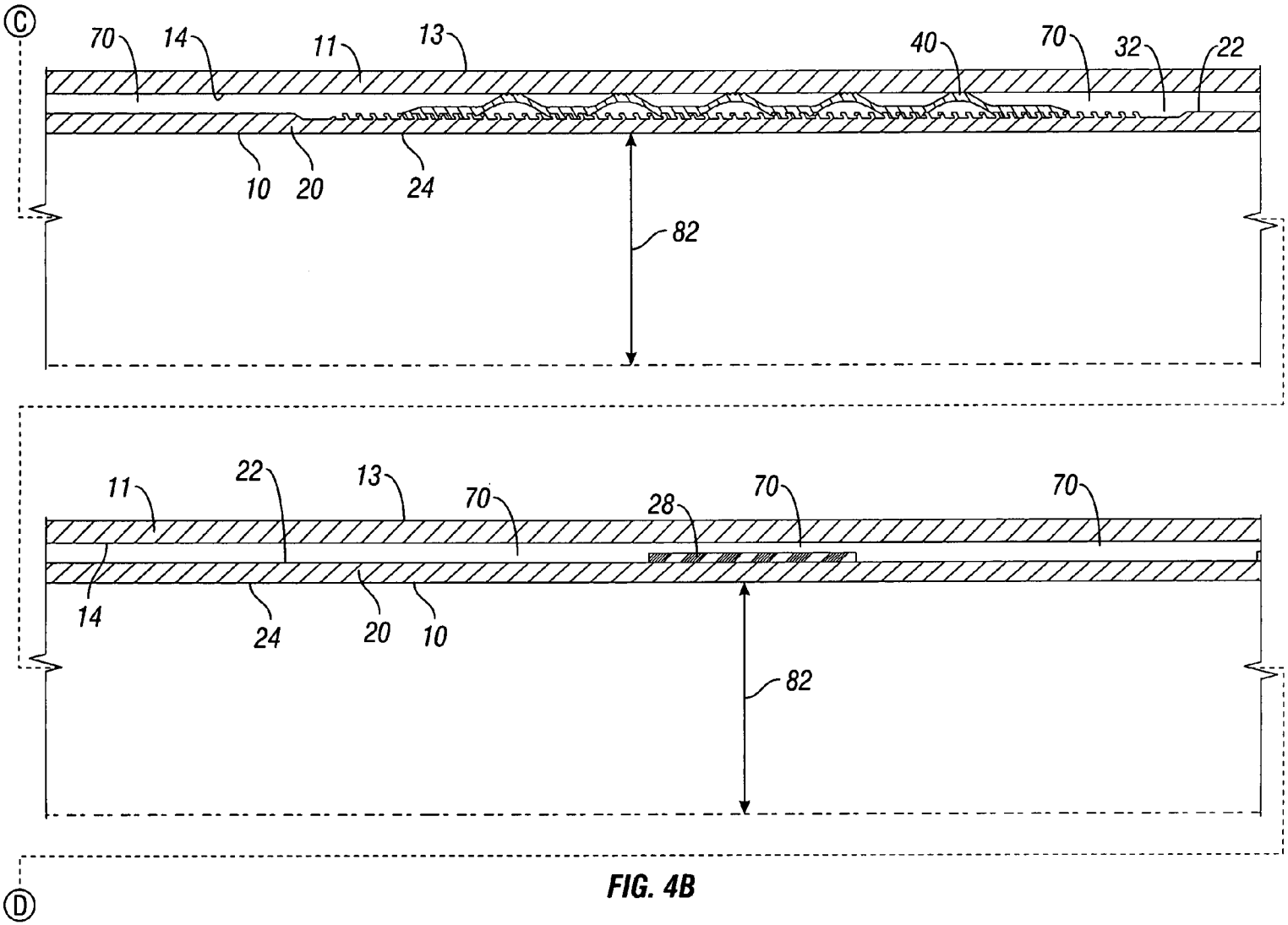
FIG. 4B is a cross-sectional view of the middle section of the upper casing and the middle section of the expandable casing shown in FIG. 1B with the middle section of the expandable casing shown in its partially expanded or by-pass position.
Figure 4C:
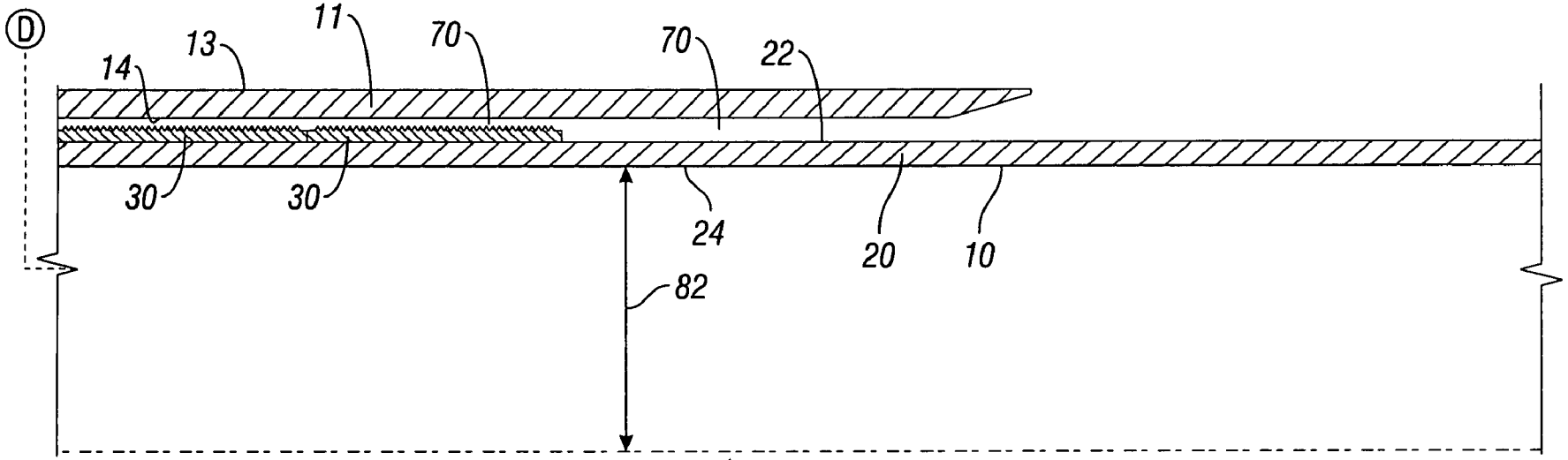
FIG. 4C is a cross-sectional view of the lower section of the upper casing and the lower section of the expandable casing shown in FIG. 1C with the lower section of the expandable casing shown in its partially expanded or by-pass position.

Expansion of expandable casing 10 from its run-in position to its partially expanded position may be accomplished by any method, device, or system know to persons of ordinary skill in the art. In one specific embodiment, expandable casing 10, including its hanger 21, may be expanded using one or more swages of known size so that expandable casing 10 is expanded to a predetermined size to ensure a secure connection between the newly run expandable casing 10 and upper casing 11. For example, a first swage can be used to partially expand expandable casing 10 from the run-in position (FIGS. 1A-1C) to the partially expanded position (FIGS. 4A-4B). As illustrated in FIGS. 4A-4C, due to the partial expansion of expandable casing 10, the diameter of expandable casing 10 is increased and is now determined by radius 82. Additionally, recess 26 is now flattened (illustrated by the dashed line 26') so that expandable casing 10 has a substantially constant diameter determined by radius 82. Radius 82 is larger than radius 80, but smaller than radius 15 of casing 11. Seal 28 and permanent slips 30 expand in diameter, but are still spaced from upper casing inner wall 14. In this arrangement, flow path 70 is reduced, but still exists between inner wall surface 14 of casing 11 and outer wall 22 of housing 20 of expandable casing 10 and between slips 40. Gripping elements 54 on peaks 50 of slips 40 grip upper casing inner wall 14 to anchor expandable casing 10.

Cement (not shown) is then pumped into expandable casing 10 using any device, system, or method known to persons of ordinary skill in the art. The cement flows out the lower end of expandable casing 10 and back up the exterior of casing 10. As the cement flows up the outside expandable casing 10, wellbore fluids within the space into which the cement is flowing, as well as excess cement that is pumped into the well, are forced out of those annular spaces and into flow path 70. The wellbore fluids and excess cement are then carried up into upper casing 11 and out of the well. Therefore, flow path 70 permits fluids within the well to flow from areas of the wellbore where cement is being pumped. The anchoring engagement of gripping elements 54 with upper casing 11 prevents upward movement of expandable casing 10 during cementing.

After sufficient circulation of fluids from the wellbore, and sufficient placement of cement within the wellbore around expandable casing 10 to fix expandable casing 10 within the wellbore, expandable casing 10 and its hanger 21 are further expanded to the final position shown in FIGS. 5A-5C. The second expansion may be performed by a larger, swage than the first swage, so that expandable casing 10 is placed in its set position (FIGS. 5A-5C). By using a second swage of known size, the likelihood of over-expanding expandable casing 10 is reduced. As a result of the additional expansion of expandable casing 10, the diameter of expandable casing 10 is increased and is now determined by radius 84. Radius 84 is larger than radius 82, but smaller than radius 16 of the overlapping lower portion of casing 11. Radius 84, however, is now substantially equal to nominal radius 15 of casing 11 so that a substantially constant diameter wellbore, or mono-diameter bore, is formed.

As shown in FIGS. 5A-5C, the additional expansion of expandable casing 10 causes gripping elements 54, 58 of slips 40 to be further compressed into inner wall surface 14 of casing 11, further securing expandable casing 10 to inner wall surface 14 of upper casing 11. As discussed above, due to ends 42, 44 of slips 40 being fixed to pocket 32, slips 40 are not permitted to slide axially in this embodiment. As a result, slips 40 compressed into the available space between teeth 36 and teeth 66. Further, seal 28 becomes sealingly engaged with inner wall surface 14 of casing 11 to block flow path 70. Permanent slips 30 engage inner surface 14 of casing 11 to further secure expandable casing 10 to inner wall surface 14 of upper casing 11 (FIGS. 5B-5C).

As disclosed herein, expandable casing 10 having slips 40 for anchoring expandable casing 10, as well as the methods of installing expandable casing 10, provide zonal isolation by using partial expansion of expandable casing 10 to anchor expandable casing 10 without blocking flow path 70. As a result, wellbore fluids within the wellbore being displaced by cement can return around hanger 21 of expandable casing 10 into upper casing 11 and to the surface of the well. Thereafter, flow path 70 is blocked, or shut-off, by further expansion of expandable casing 10, which causes seal 28 to seal off flow path 70. As mentioned above, expansion of expandable casing 10 may be accomplished using any device or method known to persons of ordinary skill in the art.

In another specific embodiment, slips 40 are not bonded or welded to pockets 32. Instead, slips 40 are disposed within their respective pockets so that an upper end 42 of each slip 40 is capable of moving in an upward direction during expansion of expandable casing 10. Preferably, the upper end of each slip 40 moves upward relative to housing 20 while the lower end remains fixed with housing 20.

In this embodiment, when each slip 40 is in its run-in position, each slip 40 is shorter than its pocket 32 and its upper end 42 is spaced below the upper end of its pocket 32. In addition to the engagement of teeth 66 with teeth 36 to retain slip 40 within pocket 32, discussed in greater detail above, a circumferential, expansible band (not shown) may extend around each set of slips 40 to retain them in their pockets 32.

During cementing and setting, each slip 40 expands in length by slip 40 engaging inner wall surface 14 of upper casing 11 causing slip 40 to ratchet up teeth 36. Additionally, because of the angles of teeth 66 and teeth 36, slip 40 is compressed at least partially in an upward direction during expansion of expandable casing 10. Preferably, the compression of slips 40 is in a single direction, e.g., upward.

In this embodiment, expandable slip 40 has a run-in length and a longer set length. When compressed into inner wall surface 14 of upper casing 11 by expansion of housing 20 (discussed in greater detail above), each expandable slip 40 expands or lengthens. Additionally, the upper end 42 of each slip 40 slides slightly upward due to the compression forces exerted on expandable slip 40 by the expansion of housing 20. In these circumstances, retaining members 34, 64 are preferably designed to allow upward movement of slip upper end 42 and prevent downward movement of slip lower end 44. When a radial inward force is applied to peaks 50 due to the contact with upper casing 11, peaks 50 begin to flatten, causing slips 40 to lengthen. The upper ends 42 are urged upward and the lower ends 44 are urged downward because of the flattening movement of peaks 50. Thus, as mentioned above, in a preferred embodiment, retaining members 34 and 64 are teeth 36, 66 with one of teeth 36, 66 angled upward and the other of teeth 36, 66 angled downward to permit upward movement of upper end 42 or sliding along the length of pocket 32 but prohibiting downward movement of lower end 44 or sliding along the length of pocket 32. The compression of expandable slips 40 results in the length of each expandable slip 40 increasing from its run-in length to its set length.

Although in this embodiment, expandable slips 40 are described as ratcheting in an upward direction, expandable slips 40 and pockets 32 can be easily modified to ratchet in a downward direction by reversing the angles of teeth 36, 66 and fixing upper end 42 of slip 40 and permitting lower end 44 to slide.

It is also to be understood that although these embodiments are discussed as having one end, either upper end 42 or lower end 44 fixed to pocket 32, in another specific embodiment, neither upper end 42 nor lower end 44 is fixed to pocket 32. Moreover, teeth 36 and teeth 66 may be disposed both in an upward direction and a downward direction so that as housing 20 is expanded, upper end 42 ratchets in an upward direction and lower end ratchets in a downward direction.

It is to be understood that the invention is not limited to the exact details of construction, operation, exact materials, or embodiments shown and described, as modifications and equivalents will be apparent to one skilled in the art. For example, when placed in the partially expanded position, the expandable slips are not required to remain at their run-in length. Instead, expandable slips may be slightly lengthened or shortened due to the expansion of the expandable casing housing from the run-in position to the partially expanded position. Moreover, the expandable slips may have any shape desired or necessary for providing a flow path between them when the expandable casing is placed in its partially expanded position. Also, the expandable slips may be retained to the outer surface of the housing of the expandable casing using any device or method known to persons of ordinary skill in the art. In addition, the housing of the expandable casing optionally may have only one set of expandable slips along any one cross-sectional view of the housing. In other words, instead of having one set of slips disposed directly above another set of slips (as illustrated in FIGS. 1A-1C and 4A-5C), the housing may have only one set of slips, e.g., the set of slips shown in FIGS. 1A, 4A, and 5A without the set of slips shown in FIGS. 1B, 4B, and 5B. Moreover, even though it is preferred that one of teeth 36, 66 is angled upwardly and the other of teeth 36, 66 is angled downwardly, only one of teeth 36 or teeth 66 may be angled upwardly or downwardly to provide the desired upward or downward, respectively, biting force discussed above. Alternatively, neither teeth 36 nor teeth 66 may be angled upwardly or downwardly. Further, the upper section of casing 11 could be conventional, non-expandable casing. And, upper casing 11 is not necessarily the uppermost section of casing. Upper casing 11 could be expandable casing having an upper end that secures and seals into another casing string located above. Accordingly, the invention is therefore to be limited only by the scope of the appended claims.

What is claimed is:

1. A hanger assembly for securing a string of expandable casing to an upper casing, the hanger assembly comprising:

a radially expandable housing for securing to an upper end of the expandable casing and locating within a lower portion of the upper casing;

an annular radially expandable seal on the housing; and at least one lengthwise expandable slip disposed around a circumference of a circularly-shaped portion of the housing, at least one of the at least one lengthwise expandable slips comprising an elongated strip having a run-in position comprising a wave-shape with a peak and two valleys disposed on either side of the peak, the expandable housing being radially expandable from the run-in position to a partially expanded position, wherein the peak contacts an inner wall of the upper casing to anchor the expandable casing, and the seal is still spaced from the inner wall of the upper casing to provide a flow path, and the expandable housing being further expandable from the partially expanded position to a set position, wherein the peak bites into the inner wall of the upper casing causing at least one of the at least one lengthwise expandable slips to become compressed and the seal to seal against the upper casing.

2. The hanger assembly of claim 1, wherein the housing has at least one elongated axially extending pocket, at least one of the at least one expandable slips being located in the pocket.

3. The hanger assembly of claim 2, wherein the peak comprises at least one gripping element disposed on an outer surface of at least one of the at least one expandable slips;

a slip retaining member is disposed on a slip inner surface of at least one of the at least one expandable slips, and at least one of the at least one pockets includes a pocket retaining member for matingly engaging with the slip retaining member.

4. The hanger assembly of claim 2, wherein at least one of the valleys of the expandable slip is fixed to the housing.

5. The hanger assembly of claim 1, wherein one end of at least one of the at least one expandable slips is fixed to the housing so as to remain at the same point on the housing between the run-in and the set positions.

6. The hanger assembly of claim 1, wherein the housing and at least one of the at least one expandable slips have mating teeth that are inclined so as to allow one end of at least one of the at least one expandable slips to ratchet axially relative to the housing while at least one of the at least one expandable slips moves from the run-in position to the set position.

7. A well comprising:

a section of upper casing in the well;

a section of expandable casing extending into the well below the upper casing; and a radially expandable housing on an upper end of the expandable casing, the housing having a slip assembly and a seal, the housing, the slip assembly, and the seal being located within a lower portion of the upper casing and spaced from an inner surface defined by a diameter of the lower portion of the upper casing to define a flow path, the slip assembly comprising a lengthwise expandable slip disposed around a circumference of a circularly-shaped portion of the housing, the lengthwise expandable slip comprising an elongated strip having a run-in outer diameter in which the lengthwise expandable slip comprises a wave-shape with a peak and two valleys disposed on either side of the peak, the housing being radially expandable from a run-in outer diameter to an intermediate outer diameter, wherein the slip assembly contacts the inner surface of the lower portion of the upper casing to anchor the expandable casing, and the seal is still spaced from the inner surface of the lower portion of the upper casing to permit a fluid to flow through the flow path, and the housing being expandable from the intermediate outer diameter to a set diameter wherein the seal seals against the inner surface of the outer casing to block the flow path.

8. The well of claim 7, wherein the slip assembly has a first end and a second end and one of the first end or the second end is fixed to the housing.

9. The well of claim 7, wherein the housing and the slip assembly have mating teeth that are inclined, so that one end of the slip assembly is fixed and the other end of the slip assembly slides to elongate the slip assembly.

10. The well of claim 7, wherein the slip assembly has a plurality of peaks and a plurality of valleys and each of the plurality of peaks contacts the inner surface of the lower portion of the upper casing when the housing is radially expanded from the run-in outer diameter to the intermediate outer diameter and each of the plurality of peaks deforms when the housing is further radially expanded from the intermediate outer diameter to the set diameter.

11. The well of claim 7, wherein at least one of the valleys of the expandable slip are fixed to the housing.

12. A method of installing casing within a wellbore, the method comprising the steps of:

(a) running an expandable casing through an upper casing disposed in a wellbore, the expandable casing having a housing and an expandable slip disposed on an outer wall surface of the housing, the housing locating within a lower portion of the upper casing, defining a flow path between the housing and the lower portion of the upper casing, the expandable slip comprising an elongated strip disposed around a circumference of a circularly-shaped portion of the housing and having a run-in position in which the expandable slip comprises a wave-shape with a peak and two valleys disposed on either side of the peak;

(b) partially expanding the housing so that the expandable slip contacts an inner wall surface of the lower portion of the upper casing to anchor the expandable casing but not block the flow path; then (c) pumping a fluid through the flow path and along the outer wall surface of the housing; and then (d) further expanding the housing causing the expandable slip to compress and the fluid flow path to be blocked.

13. The method of claim 12, wherein the fluid is cement that is pumped up an annulus surrounding the expandable casing during step (c), causing cement returns to flow through the flow path.

14. The method of claim 12, wherein the upper casing is run and cemented into the wellbore prior to step (a).

15. The method of claim 12, wherein a lower section of the wellbore is drilled below the upper casing before step (a).

16. The method of claim 12, wherein the outer wall surface of the housing includes at least one seal and during step (d) at least one of the at least one seals engages the inner wall of the upper casing and blocks the flow path.

17. The method of claim 12, wherein step (a) comprises providing the lower portion of the upper casing with a larger inner diameter than a remaining portion of the upper casing.

18. The method of claim 12, wherein during step (d), the expandable slip bites into the inner wall surface of the upper casing and an upper end of the expandable slip slides in an upward direction relative to a lower end of the expandable slip.

19. The method of claim 12, wherein the expandable slip comprises a lengthwise elongated strip.

20. The method of claim 12, wherein the expandable casing comprises a plurality of lengthwise expandable slips each comprising an elongated strip.

* * * * *